US006715903B2

(12) United States Patent
Wang

(10) Patent No.: US 6,715,903 B2
(45) Date of Patent: Apr. 6, 2004

(54) LIGHT MOUNTING ASSEMBLY WITH MOVABLE TAB

(75) Inventor: James P. Wang, Blacksburg, VA (US)

(73) Assignee: Hubbell Incorporated, Orange, CT (US)

( * ) Notice: Subject to any disclaimer, the term of this patent is extended or adjusted under 35 U.S.C. 154(b) by 81 days.

(21) Appl. No.: 09/964,885

(22) Filed: Sep. 28, 2001

(65) Prior Publication Data

US 2002/0118544 A1 Aug. 29, 2002

Related U.S. Application Data

(63) Continuation-in-part of application No. 09/877,234, filed on Jun. 11, 2001, now abandoned, which is a continuation-in-part of application No. 09/794,169, filed on Feb. 28, 2001, now abandoned.

(51) Int. Cl.[7] ..... F21V 17/00

(52) U.S. Cl. ..... 362/364; 362/365; 362/368; 52/506.09

(58) Field of Search ..... 362/364, 365, 362/368, 406; 52/506.01, 506.04, 506.06, 506.09

(56) References Cited

U.S. PATENT DOCUMENTS

| | | | | |
|---|---|---|---|---|
| 4,408,262 A | | 10/1983 | Kusmer | |
| 4,972,339 A | | 11/1990 | Gabrius | |
| 5,045,985 A | | 9/1991 | Russo et al. | |
| 5,746,507 A | | 5/1998 | Lee | |
| 5,957,572 A | | 9/1999 | Wedekind et al. | |
| 5,997,158 A | | 12/1999 | Fischer et al. | |
| 6,059,422 A | | 5/2000 | Fischer et al. | |
| 6,082,878 A | | 7/2000 | Doubek et al. | |
| 6,116,749 A | | 9/2000 | Quiogue | |
| 6,132,070 A | * | 10/2000 | Vosika et al. | 362/368 |
| 6,273,592 B1 | * | 8/2001 | Herst et al. | 362/342 |

* cited by examiner

*Primary Examiner*—Stephen Husar
*Assistant Examiner*—Guiyoung Lee
(74) *Attorney, Agent, or Firm*—Marcus R. Mickney; Alfred N. Goodman

(57) ABSTRACT

A light mounting panel for connecting to a luminaire frame having a base with an upper and a lower surface and having first, second, third and fourth outer edges. The base has an opening and an inner edge defining the opening. The first outer edge being opposite the second outer edge and the third outer edge being opposite the fourth outer edge. First, third and fourth walls extend upwardly from the upper surface of the base at the first, third and fourth outer edges, respectively, and contactable with internal flanges of the existing luminaire frame to align the mounting panel with the existing luminaire frame during installation. A second wall extends upwardly and inwardly from the upper surface of the base at the second outer edge. A first fixed tab extends laterally outwardly from the first wall to engage a first slot in the luminaire frame. A second tab extends outwardly from the second wall and is movable between an insertion position within a periphery of the base and an installed position extending laterally outwardly from the periphery to engage a second slot in the luminaire frame.

59 Claims, 6 Drawing Sheets

LIGHT MOUNTING ASSEMBLY WITH MOVABLE TAB

RELATED APPLICATIONS

This application is a continuation-in-part of U.S. patent application Ser. No. 09/877,234, filed Jun. 11, 2001 now abandoned, which is a continuation-in-part of U.S. patent application Ser. No. 09/794,169, filed Feb. 28, 2001, abandoned, both of which are hereby incorporated by reference.

FIELD OF THE INVENTION

The present invention relates to a mounting panel for connecting to a luminaire frame that has an internal flange and slots. The mounting panel supports a ballast box and an optical assembly. A tab on the mounting panel is movable between an insertion and an installed position for engaging the luminaire frame. Once the panel has been inserted within the frame, the tab is moved from the insertion position to an installed position engaging the luminaire frame, thereby securing the mounting panel to the luminaire frame.

BACKGROUND OF THE INVENTION

Canopy luminaires are designed to provide a downward and outward distribution of light for a wide variety of applications, such as exterior illumination of gasoline service stations, convenience stores and drive-through restaurants. Canopy luminaires typically include a box-like canopy fixture housing mounted to a horizontal ceiling or canopy support structure for enclosing and supporting lighting components and related structure of the canopy luminaire. The lighting components of the canopy luminaire include electrical control elements, such as ballasts, capacitors and ignitors, which are electrically coupled to a high intensity discharge (HID) lamp. The lamp is typically mounted in a lamp socket within the canopy fixture, which emits approximately one-half of the generated light upwardly. A reflector is provided above the light-emitting section of the lamp to distribute that light downwardly through a glass or plastic lens assembly that encloses the lamp.

Replacement or conversion of canopy luminaires generally requires several or all of the existing lighting components and related structure of the luminaire to be removed from the existing canopy fixture housing to provide sufficient room in the fixture housing for installation of the replacement luminaire. In the past, replacement canopy luminaires have been shipped from the manufacturer as disassembled components which are then individually mounted and wired in the canopy fixture housing. Installation and wiring of the separate retrofit luminaire components in an existing canopy fixture installation is complicated and time consuming as the canopy fixture is generally only accessible by ladder. As any location or site may require replacement or conversion of several canopy luminaires, the difficulty associated with installing, mounting and wiring separate retrofit components of the existing canopy luminaires is significantly increased.

Examples of existing retrofit canopy luminaire assemblies are disclosed in the following references: U.S. Pat. Nos. 5,997,158 to Fischer et al.; and 6,059,422 to Fischer et al.

Thus, improved light mounting panels, light mounting assemblies and luminaire assemblies are needed that are simple and easy to install, and that minimize the required installation time.

SUMMARY OF THE INVENTION

Accordingly, objects of the present invention are to provide a light mounting panel for connecting to a luminaire frame that is simple and inexpensive to manufacture, and quick and easy to install.

The foregoing objects are basically attained by a light mounting panel for connecting to a luminaire frame having a base that has an upper surface and a lower surface and first, second, third and fourth outer edges. The base has an opening and an inner edge defining the opening. The first outer edge is opposite the second outer edge, while the third outer edge being opposite the fourth outer edge. First, third and fourth walls extend upwardly from the upper surface of the base at the first, third and fourth outer edges, respectively, and are contactable with internal flanges of the existing luminaire frame to align the mounting panel with the existing luminaire frame during installation. A second wall extends upwardly and inwardly from the upper surface of the base at the second outer edge. A first fixed tab extends laterally outwardly from the first wall to engage a first slot in the luminaire frame. A second tab extends outwardly from the second wall and is movable between an insertion position within a periphery of the base and an installed position extending laterally outwardly from the periphery to engage a second slot in the luminaire frame.

The light mounting panel of the present invention connects to a luminaire frame that has internal flanges and slots. Once the light mounting panel has been installed in a luminaire frame, a ballast box may be inserted through an opening in the frame. The light mounting panel may have locator tabs to position a ballast box on the panel. Furthermore, an optical assembly may then be attached to the ballast box.

The present invention is an easily mountable attaching system for retrofitting existing luminaires that have an interior flange and horizontal slots, such as canopy lights. The host housing has at least two vertical walls opposite each other with horizontal slots above the horizontal surface of the housing. Vertical walls of the present invention fit within the opening of the host housing.

According to a preferred embodiment, one of the vertical walls on the panel can have two horizontal tabs that are fixed at 90 degrees to the wall. These tabs are slid into the horizontal slots of the host housing. The opposite vertical wall can have two pivot tabs that are at an angle to the wall so the panel may clear the host housing upon installation. The pivot tabs are then bent into the horizontal slots in the host housing on the wall opposite the fixed tabs. Slots can be provided in the panel that allow for insertion of a screwdriver for bending the pivot tabs into the slots of the host housing.

The panel has an opening for insertion of a ballast housing. Four centering tabs can be located around the perimeter of the panel opening to aid in positioning the ballast housing in the proper location. A front to rear tab can locate the ballast housing by being positioned in the channel section of the ballast housing. In this manner, the present invention provides a simple, strong and quick retrofit panel for existing luminaires.

Other objects, advantages and salient features of the invention will become apparent from the following detailed description, which, taken in conjunction with the annexed drawings, discloses a preferred embodiment of the invention.

As used in this application, directional terms, such as upper and lower, are intended to facilitate the description of the present invention. Such terms are merely indicate relative of the elements of the present invention and do not limit the invention to any specific orientation.

BRIEF DESCRIPTION OF THE DRAWINGS

Referring now to the drawings that form a part of the original disclosure.

DETAILED DESCRIPTION OF THE INVENTION

Figure 1:
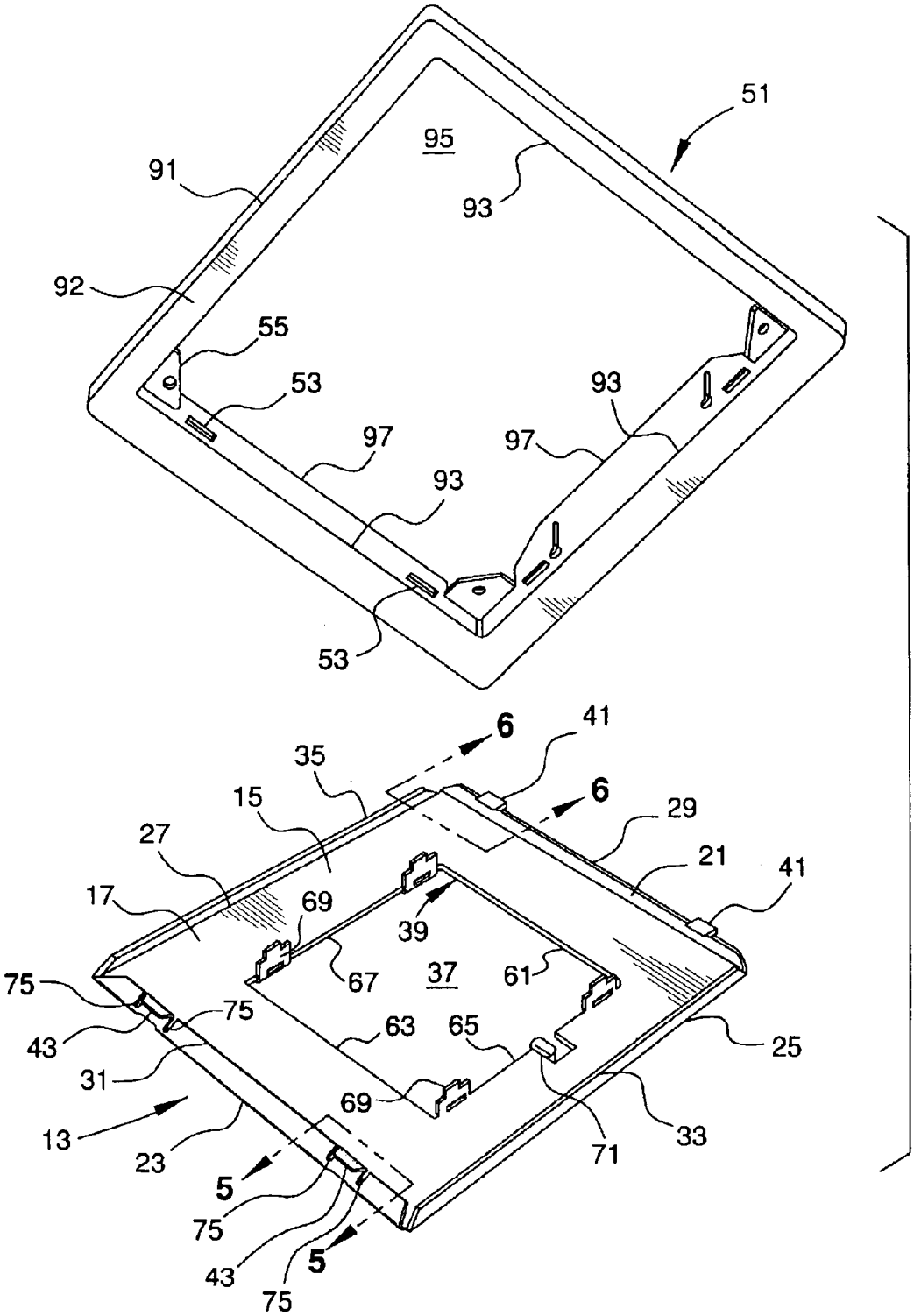
FIG. 1 is an exploded, perspective view of a light mounting panel assembly, including a mounting panel and a luminaire frame according to a first embodiment of the present invention.

As shown in FIGS. 1–15, the present invention according to a first embodiment is an easily attachable mounting panel 13 for connecting to a luminaire frame 51 having interior flanges 55 and horizontal slots 53, such as a Philips MPF 211/212 canopy luminaire. The mounting panel 13 has at least one first tab 41 that is fixed and engages a first horizontal slot 52 of the luminaire frame 51. The mounting panel 13 also has at least one second tab 43 that is movable to engage a second horizontal slot 53 in the luminaire frame 51. A slot 73 in the base 15 of the mounting panel 13 allows insertion of an apparatus, such as a screwdriver 101, for moving the second tab from an insertion position to an installed position. The mounting panel 13 shown in FIGS. 1 and 2 has two first tabs 41 and two second tabs 43.

Figure 2:
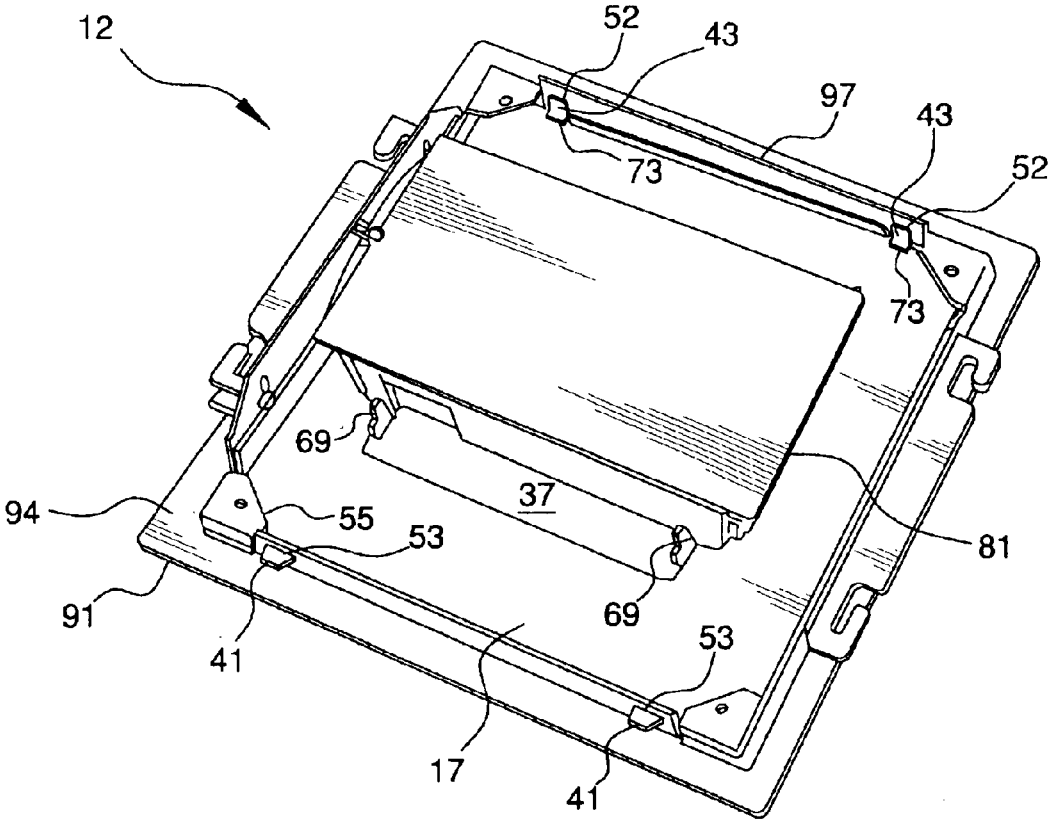
FIG. 2 is a top perspective view of a light mounting assembly of FIG. 1, including a mounting panel, a luminaire frame and a ballast box.
Figure 3:
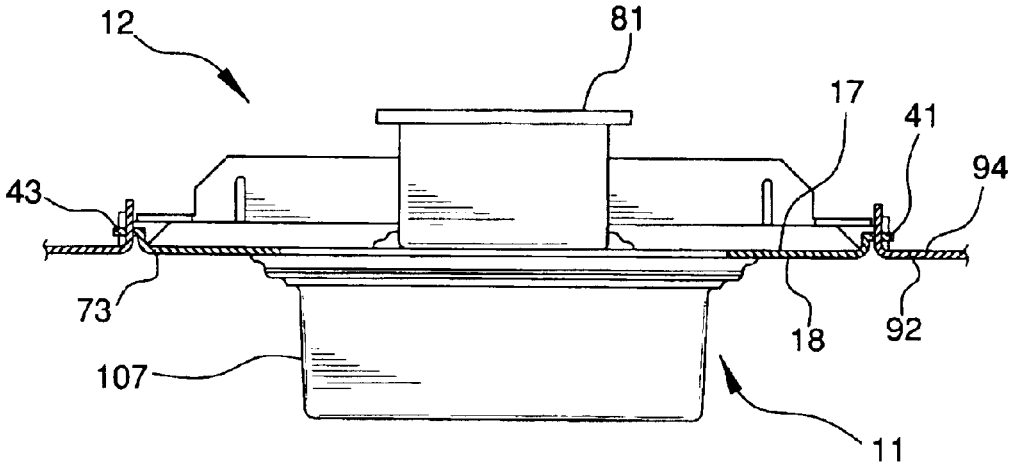
FIG. 3 is a side elevational view of a light mounting assembly of FIG. 1, including a mounting panel, a luminaire frame, a ballast box and an optical assembly.
Figure 4:
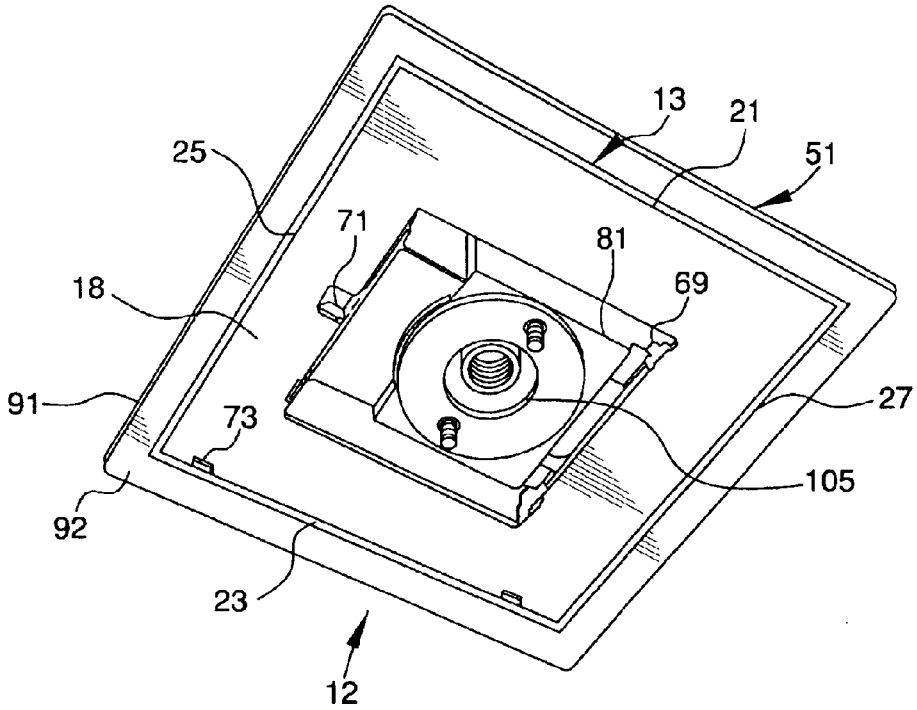
FIG. 4 is a bottom perspective view of a light mounting assembly of FIG. 1, including a mounting panel, a luminaire frame and a ballast box.
Figure 5:
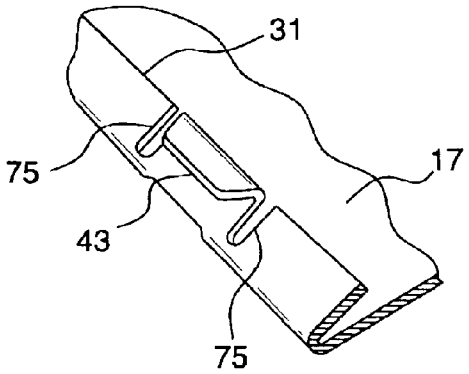
FIG. 5 is a partial, top perspective view of the mounting panel of FIG. 1 with the movable tab in an insertion position.
Figure 6:
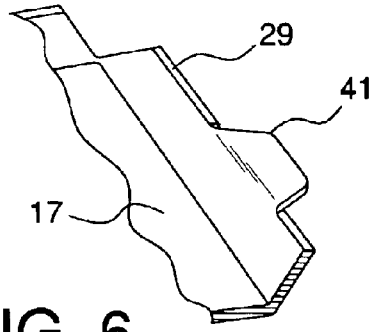
FIG. 6 is a partial, top perspective view of the mounting panel of FIG. 1 with the fixed tab.
Figure 7:
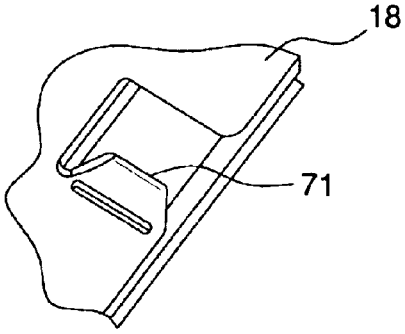
FIG. 7 is a partial, bottom perspective view of the mounting panel of FIG. 1 with the fourth tab.
Figure 8:
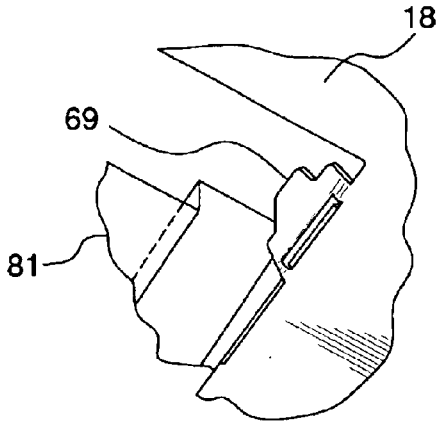
FIG. 8 is a partial, bottom perspective view of the mounting panel of FIG. 1 with the third tab.
Figure 9:
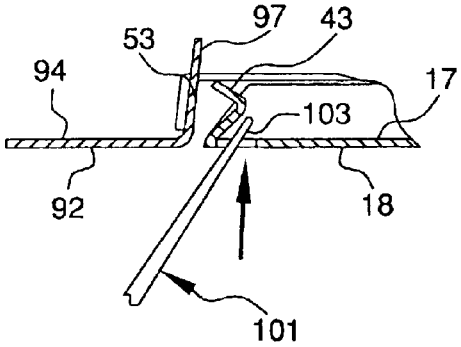
FIGS. 9 and 10 are a partial, side elevational view in cross-section and a top perspective view, respectively, of the mounting panel of FIG. 1, with a movable tab in insertion position, including a slot for receiving an apparatus to move that tab.
Figure 10:
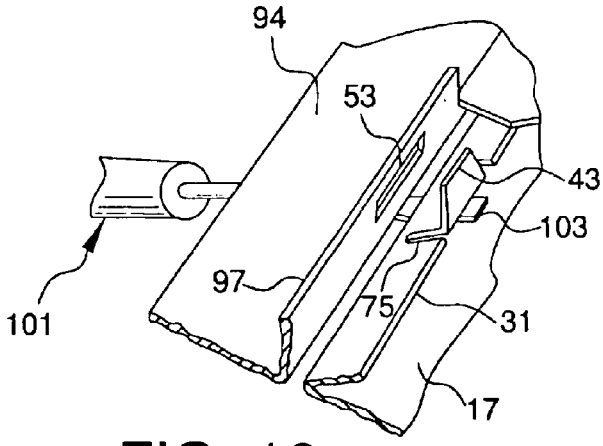
Figure 11:
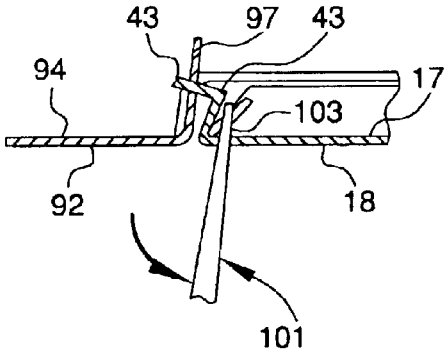
FIGS. 11 and 12 are a partial, side elevational view in cross-section and a top perspective view, respectively, of the mounting panel of FIG. 1, with a movable tab being moved from an insertion position to an installed position by an apparatus inserted through a slot in the base.

A light mounting assembly 12 according to the present invention includes the mounting panel 13, luminaire frame 51 and ballast box 81, as shown in FIGS. 2 and 4. A luminaire assembly 11 according to the present invention includes the light mounting assembly 12 and an optical assembly 107 attached thereto, as shown in FIG. 3.

As shown in FIG. 1, the mounting panel 13 has an upper surface 17 and a lower surface 18. The panel 13 has four outer edges 21, 23, 25 and 27. An opening 37 in the panel 13 is defined by an inner edge 39. A ballast box 81 may be inserted through the opening 37 and positioned on and supported by the upper surface 17 of the panel 13. Preferably, the inner edge is quadrilateral, having first, second, third and fourth inner edges 61, 63, 65 and 67, respectively. The first inner edge 61 is opposite the second inner edge 63, and the third inner edge 65 is opposite the fourth inner edge 67.

Panel walls 29, 31, 33 and 35 extend upwardly from the upper surface 17 of the panel 13 at each of the four outer edges. The first wall 29, third wall 33 and fourth wall 35 extend from the first outer edge 21, third outer edge 25 and fourth outer edge 27, respectively. The first wall 31 is opposite the second wall 33, and the third wall 35 is opposite the fourth wall 37. Preferably, the first, third and fourth walls extend substantially perpendicularly relative to upper surface 17 from their respective outer edges and are of the same height for contacting a flange 55 in the luminaire frame 51. The second wall 31 extends upwardly and inwardly from the second outer edge 23. The second wall 31 extends inwardly forming an acute angle between the second wall and the planar base 15. The acute angular orientation allows the second wall and the second movable tabs 43 to clear a frame wall 97 when installing the mounting panel 13, after the first fixed tabs have been inserted in the first frame slots 52.

Each fixed first tab 41 extends laterally outwardly from the first wall 29 to engage a first slot 52 in the luminaire frame 51, as shown in FIG. 2. Preferably, the fixed first tabs 41 extend substantially perpendicularly from the first wall 29.

Each movable second tab 43 extends outwardly from the second wall 31. The second tabs 43 are movable from an insertion position within a periphery of the base 15, as shown in FIG. 1, to an installed position extending beyond the periphery of base 15, as shown in FIG. 2. Slots 73 in the base 15 of the panel 13 proximal each second tab 43 allows an apparatus to be inserted to move each second tab from an insertion position to an installed position, as shown in FIGS. 9–14. Preferably, a flat end 103 of a screwdriver 101 is inserted into the slot 73 from below base 15 for moving the second tab 43 from an insertion position to an installed position. A notch 75 on each side of each second tab 43 eases movement of the second tab 43 by an apparatus inserted into the slot 73. Preferably, the fixed first tabs 41 are on an opposing edge from the movable second tabs 43.

Third tabs 69 extends upwardly, preferably substantially perpendicularly, from the third and fourth inner edges 65 and 67. The third tabs 69 position a ballast box 81 between the third and fourth outer edges 25 and 27. A fourth tab 71 extends upwardly, preferably substantially perpendicularly, from the third inner edge 65. The fourth tab positions a ballast box 81 between the first and second outer edges 21 and 23. Preferably, the fourth tab 71 is oriented substantially perpendicularly to the third tabs 69.

The luminaire frame 51 is attached to a ceiling structure or canopy to support a luminaire assembly. The luminaire frame 51 has a base 91 with an opening 95 defined by an inner edge 93. The base 91 has a lower surface 92 and an upper surface 94. The frame opening 95 receives the mounting panel 13. A frame wall 97 extends substantially perpendicularly from the upper surface 94 of the frame base 91 at the inner edge 93. The frame wall 97 has first slots 52 and second slots 53 for receiving the first and second tabs 41 and 43 of the mounting panel 13. A flange 55 extending laterally outwardly and radially inwardly into opening 95 from the frame wall 97 prevents the first wall 29, third wall 33 and fourth wall 35 of the mounting panel 13 from being inserted too far through the frame 51, thereby aligning the mounting panel first and second tabs 41 and 43 with the first and second slots 52 and 53 of the frame. The frame slots 52 and 53 may be located in any position along the frame wall 97 that allows the mounting panel first and second tabs 41 and 43 to engage the slots.

A ballast box 81 is inserted through the mounting panel opening 37 and positioned on the upper surface 17 of the base 15. The third tabs 69 receive and support the ballast box 81. The third tabs 69 locate the ballast box 81 between the third and fourth outer edges 25 and 27 of the mounting panel. The fourth tab 71 locates the ballast box 81 between the first and second outer edges 25 and 27. The ballast box 81 has a socket connection 105, as shown in FIG. 4, that is accessible through the mounting panel opening 37.

An optical assembly 107, as shown in FIG. 3, is attached to the light mounting assembly 12 through the socket connection 105 in the ballast box 81. The ballast box 81, the optical assembly 107 and the connection therebetween are discussed in more detail in pending U.S. patent application Ser. No. 09/511,151, entitled "Ballast Housing for Luminaire", the subject matter of which is hereby incorporated by reference.

Preferably, the mounting panel 13, including the base 15, the fixed first tabs 41, the movable second tabs 43, and the third and fourth tabs 69 and 71 as shown in FIG. 1, is unitarily formed of a single piece of metal material.

Second Embodiment

Figure 15:
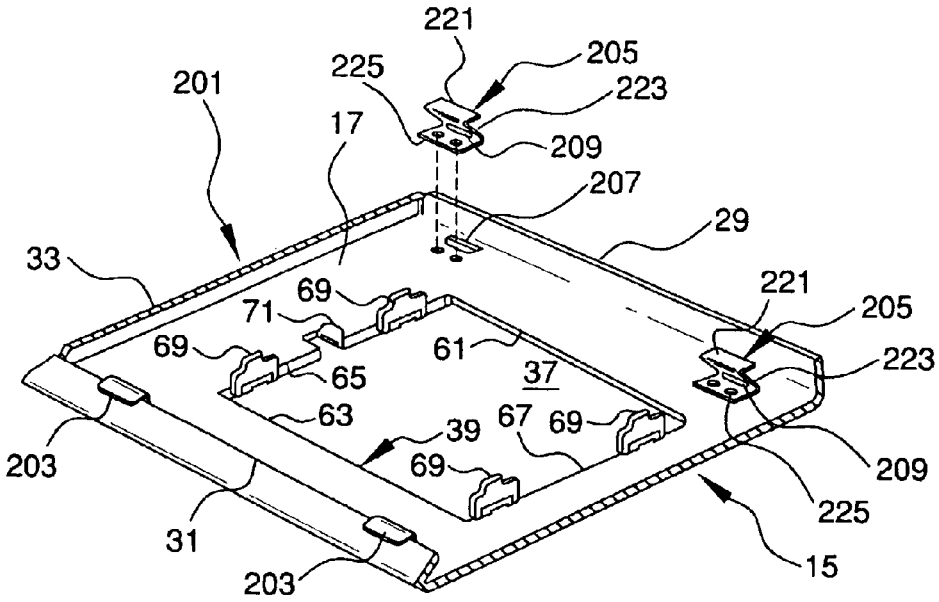
FIG. 15 is a perspective view in partial cross-section of a light mounting panel, according to a second embodiment of the present invention, with the movable tab attached to the upper surface of the base.
Figure 16:
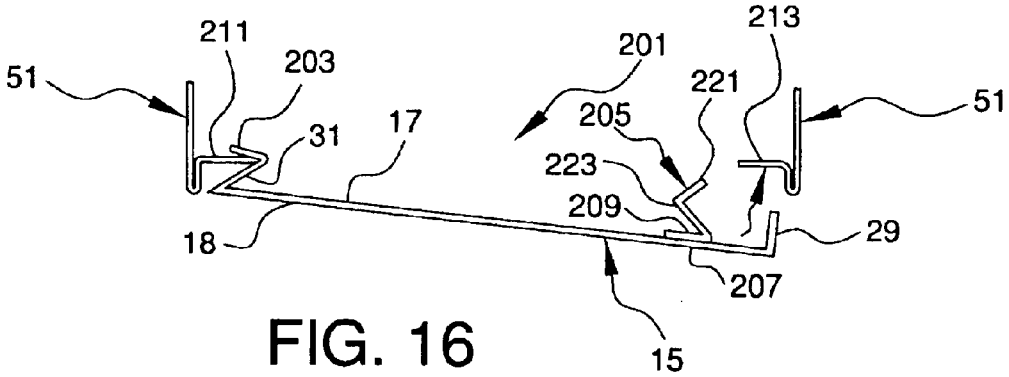
FIGS. 16 and 17 are side elevational views in cross-section of the mounting panel of FIG. 15, showing the movable tab being moved from an insertion position to an installed position.
Figure 17:
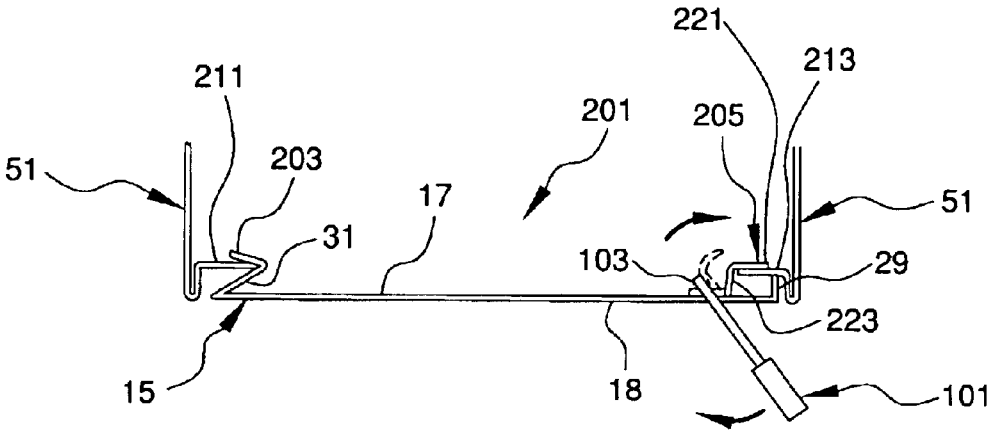

A second embodiment of a light mounting panel 201 is shown in FIGS. 15–17. The features of the second embodiment that are the same as those of the first embodiment are identified with the same reference numerals.

At least one fixed first tab 203 extends outwardly from the second wall 31. At least one movable second tab 205 is attached to the upper surface 17 of the base 15 of the mounting panel 201. The mounting panel 201 shown in FIGS. 15–17 has two fixed first tabs 203 and two movable second tabs 205. The orientation of the first and second tabs 203 and 205 allows the light mounting panel 201 to be installed within the luminaire frame 51 without obstruction of the first and second tabs of the panel by the internal flanges 211 and 213 of the luminaire frame.

According to the second embodiment of the invention, the fixed first tabs 203 extend outwardly from the second wall 31 of the base. Preferably, the fixed first tabs 203 extend outwardly and upwardly from the second wall 31, thereby forming an acute angle between the first fixed tabs and the second wall, as shown in FIGS. 16 and 17.

The second movable tabs 205 are attached to the upper surface 17 of the base 15 proximal the first wall 29. Preferably, the second movable tab 205 is Z-shaped. The second movable tab has a top portion 221, an intermediate portion 223, and a base portion 225. Any conventional method may be used to secure the second tabs to the base 15, including, but not limited to, fasteners, pot-riveting, welding, and spot welding. Slots 207 and 209 in the base 15 and in the base portions 225 of the second movable tabs 205 receive a tool for moving the second tabs from an insertion position (shown by dashed lines) to an installed position (shown by solid lines), as shown in FIG. 17. In the insertion position, the intermediate portions 223 of the movable second tabs 205 form an acute angle with the base portions 225. In the installed position, the intermediate portions 223 have been moved so that the intermediate portions are substantially perpendicular to the base portions 225. The top portions 221 of the movable second tabs rest upon horizontal flanges 213 of the luminaire frame 51.

The luminaire frame 51 has first and second internal, horizontal flanges 211 and 213 upon which the first and second tabs 203 and 205 rest to support the light mounting panel assembly. The first internal flange 211 is opposite the second internal flange 213.

Third Embodiment

Figure 18:
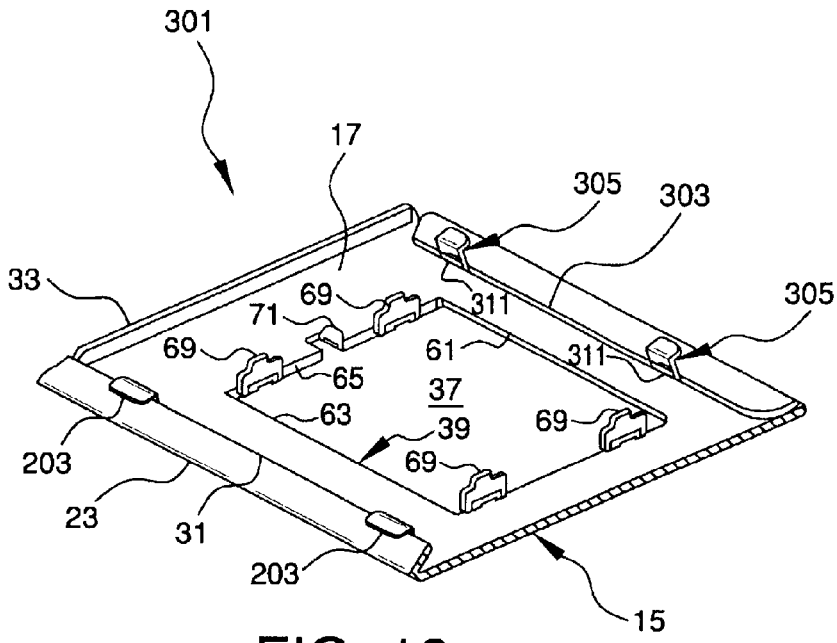
FIG. 18 is a perspective view in partial cross-section of a light mounting panel, according to another embodiment of the present invention, with an inboard movable tab extending from the first wall of the mounting panel.
Figure 19:
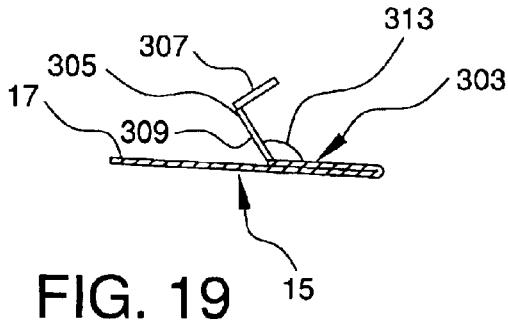
FIG. 19 is a side elevational view in cross-section of the inboard movable tab extending from the first wall in an insertion position of the mounting panel assembly of FIG. 18.
Figure 20:
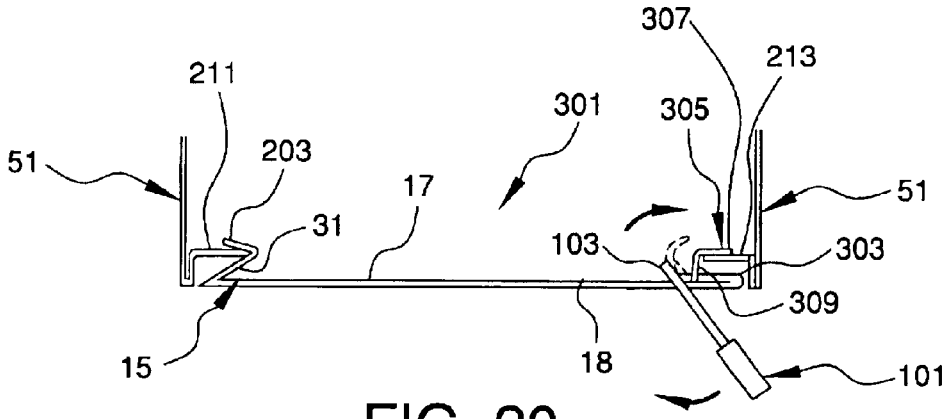
FIG. 20 is a elevational view in cross-section of the mounting panel assembly of FIG. 18, showing the movable tab being moved from an insertion position to an installed position.

A third embodiment of a light mounting panel assembly 301 of the present invention is shown in FIGS. 18–20. The features of this embodiment that are the same as those of the first and second embodiments are identified with the same reference numerals.

At least one fixed first tab 203 extends outwardly from the second wall 31. At least one movable second tab 305 extends upwardly from the first wall 303, where the first and second tabs are formed as unitary, one-piece parts or extensions of base 15 to facilitate manufacture. The mounting panel 301 shown in FIGS. 18 and 20 has two fixed first tabs 203 and two movable second tabs 305. The orientation of the first and second tabs 203 and 305 allows the light mounting panel 301 to be installed within the luminaire frame without obstruction of the first and second tabs of the panel by the internal flanges of the luminaire frame.

According to this embodiment of the invention, the fixed first tabs 203 extend outwardly from the second wall 31 of the base. Preferably, the second wall extends upwardly and inwardly from the second outer edge 23 of the base 15. Preferably, the fixed first tabs 203 extend outwardly and upwardly from the second wall 31, thereby forming an acute angle between the first fixed tabs and the second wall.

The second movable tabs 305 extend upwardly from the first wall 303, as shown in FIGS. 18–20. The first wall 303 is folded over 180 degrees onto the upper surface 17 of the base, as shown in FIG. 19. The second movable tab 305 is L-shaped. The second movable tab 305 has a first portion 307 and a second portion 309. Slots 311 in the base 15 receive a tool for moving the second tabs 305 from an insertion position to an installed position, as shown in FIG. 20. In the insertion position, the first portions 307 of the movable second tabs 305 are substantially perpendicular to the second portions 309 and the second portions 309 form an obtuse angle 313 with the first wall 29. In the installed position, the second portions 309 have been moved so that the second portions are substantially perpendicular to the first wall 29. The first portions 307 of the movable second tabs 305 rest upon horizontal flanges of the luminaire frame 51.

The luminaire frame 51 has first and second internal, horizontal flanges 211 and 213 upon which the first and second tabs 203 and 305 rest to support the light mounting panel assembly, as shown in FIG. 20. The first internal flange 211 is opposite the second internal flange 213.

ASSEMBLY AND DISASSEMBLY

As seen in FIGS. 2 and 4, the light mounting assembly 12 is completely constructed by assembling the various parts as shown in FIGS. 1, 2, 3 and 9–14. The light mounting panel 13 is secured to the luminaire frame 51 by inserting panel tabs 41 and 43 into first and second luminaire slots 52 and 53. The panel 13 is inserted into the frame opening 95. The flanges 55 prevent the panel 13 from being inserted completely through the frame opening 95 and aligns the fixed first tabs 41 with the first frame slot 52.

Figure 12:
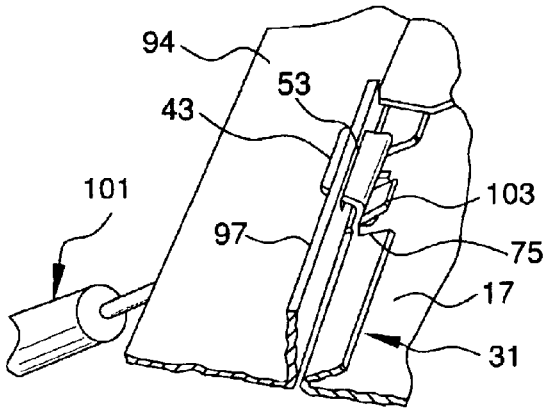
Figure 13:
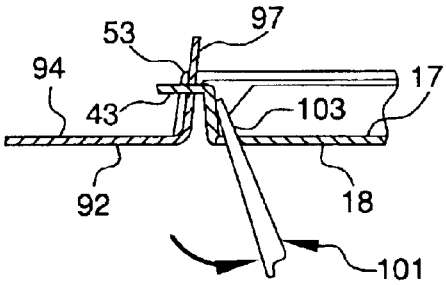
FIGS. 13 and 14 are a partial, side elevational view in cross-section and a top perspective view, respectively, of the mounting panel of FIG. 1, with the movable tab in an installed position.
Figure 14:
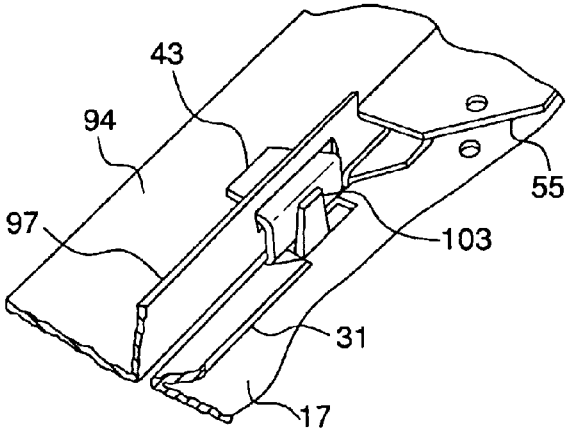

After inserting the fixed first tabs into the first frame slots 52, the panel 13 is rotated up until the third and fourth walls contact the frame flanges 55, which also aligns the movable second tabs 43 with the second frame slots 53. Preferably, the second wall 31 and the movable second tabs 43 are angled to provide clearance between the second panel wall and second tabs and the frame wall 97 to facilitate mounting the panel to the luminaire frame 51. As shown in FIGS. 9–14, each movable second tab 43 is moved from an insertion position shown in FIGS. 9 and 10 to an installed position shown in FIGS. 13 and 14. An apparatus, such as the flat end 103 of a screwdriver 101, is inserted into panel slot 73 behind the movable second tab 43 as indicated by the arrow in FIG. 9. While keeping the flat end of the screwdriver 103 in the panel slot 73, the screwdriver 101 is rotated as indicated by the arrow in FIG. 11 causing the movable second tab 43 to engage the frame slot 53 as shown in FIG. 12. Continuing to rotate the screwdriver 101 as indicated by the arrow in FIG. 13, moves the second tab 43 to the installed position of FIG. 14. The notches 75 on both sides of each second movable tab 43 allow for easier movement of the tab by the apparatus, as well as providing easier manufacturing.

Preferably, the panel walls are sized such that when the light mounting panel 13 has been installed in the luminaire frame 51, the lower surface 18 of the panel is flush with the lower surface 92 of the frame base 91. This is accomplished by sizing the depth of the flange 55 from the lower surface 92 of the frame base 91 equal to the height of the first, third or fourth panel walls 29, 33 and 35.

Once the mounting panel 13 has been attached to the luminaire frame 51, a ballast box 81 is inserted through the panel opening 37. The ballast box 81 is mounted on third and fourth tabs 69 and 71, respectively. The third tabs 69 locate the ballast box 81 between the third and fourth outer edges 25 and 27 of the panel. The fourth tab 71, preferably oriented substantially perpendicularly to the third tabs 69, locates the ballast box 81 between the first and second outer edges 21 and 23 of the panel 13. The third and fourth tabs 69 and 71 locate the ballast box so that the socket connection 105 is accessible through the panel opening 37.

As seen in FIG. 3, the luminaire assembly 11 is completely constructed by assembling the various parts as shown in FIGS. 1–14. Once the light mounting panel assembly 12 has been assembled, as shown in FIG. 4, an optical assembly 107 is attached to the socket connection 105 of the ballast box to assemble the luminaire assembly shown in FIG. 3.

Second Embodiment

As seen in FIGS. 16 and 17, the light mounting panel 201 according to the second embodiment of the present invention is secured to the luminaire frame 51 by engaging first and second panel tabs 203 and 205 with first and second luminaire frame internal flanges 211 and 213 or by inserting the first and second tabs into first and second luminaire slots (not shown). The panel assembly 201 is inserted into the frame opening in the same manner as the panel of the first embodiment. The internal flanges 211 and 213 of the luminaire frame 51 prevent the panel from being inserted completely through the frame opening and align the fixed first tabs 203 with the first frame flange 211.

After engaging the fixed first tabs 203 with the first frame flange 211, as shown in FIG. 16, the panel 201 is rotated up until the first, third and fourth walls 29, 33 and 35 of the panel contact the frame flanges 211 and 213, which also aligns the movable second tabs 205 with the second frame flange. Preferably, the second wall 31 and the movable second tabs 205 are angled to provide clearance between the second panel wall and second tabs and the frame flanges 211 and 213 to facilitate mounting the panel 201 to the luminaire frame 51. As shown in FIG. 16, each movable second tab 205 is moved from an insertion position shown in FIGS. 15 and 16 to an installed position shown in FIG. 17. An apparatus, such as the flat end 103 of a screwdriver 101, is inserted into the panel and second tab slots 207 and 209, as shown in FIG. 17. While keeping the flat 103 end of the screwdriver 101 in the panel and tab slots 207 and 209, the screwdriver is rotated as indicated by the arrow in FIG. 17 causing the movable second tabs 205 to engage the second frame flange 213. Continuing to rotate the screwdriver 101, as indicated by the arrow in FIG. 17, moves the second tab 205 to the installed position of FIG. 17. Movement of the second tab moves the intermediate portion 223 from an acute position with the base portion (insertion position) to being substantially perpendicular to the base portion (installed position). When completely installed, the first and second tabs 203 and 205 of the mounting panel 201 rest upon the first and second internal flanges 211 and 213 of the luminaire frame 51, thereby supporting the mounting panel within the luminaire frame. Once the mounting panel 201 has been secured to the luminaire frame 203, a ballast box 81 and an optical assembly 107 may be installed in the same manner as the first embodiment.

Third Embodiment

As seen in FIGS. 18–20, the light mounting panel assembly 301 according to a third embodiment of the present invention is secured to the luminaire frame 51 by engaging first and second panel tabs 203 and 305 with first and second luminaire frame internal flanges 211 and 213 or by inserting the first and second tabs into first and second luminaire slots (not shown). The panel assembly 301 is inserted into the frame opening in the same manner as the panel assembly of the first embodiment. The internal flanges 211 and 213 of the luminaire frame 51 prevent the panel from being inserted completely through the frame opening and align the fixed first tabs 203 with the first frame flange 211.

After engaging the fixed first tabs 203 with the first frame flange 211, as shown in FIG. 20, the panel assembly 301 is rotated up until the third and fourth walls 33 and 35 (FIG. 1) of the panel assembly contact the frame flanges 211 and 213, which also aligns the movable second tabs 305 with the second frame flange. Preferably, the second wall 31 and the movable second tabs 305 are angled to provide clearance between the second panel wall and second tabs and the frame flanges 211 and 213 to facilitate mounting the panel 201 to the luminaire frame 51. As shown in FIG. 20, each movable second tab 305 is moved from an insertion position shown in FIGS. 18 and 19 to an installed position shown in FIG. 20. An apparatus, such as the flat end 103 of a screwdriver 101, is inserted into the panel slots 311, as shown in FIG. 20. While keeping the flat 103 end of the screwdriver 101 in the panel slots 311, the screwdriver is rotated as indicated by the arrow in FIG. 20 causing the movable second tabs 305 to engage the second frame flange 213. Continuing to rotate the screwdriver 101, as indicated by the arrow in FIG. 20, moves the second tab 305 to the installed position of FIG. 20. Movement of the second tab 305 moves the second portion 309 from an obtuse position with the upper surface 17 of the base portion 15 (insertion position) to being substantially perpendicular to the base portion (installed position). When completely installed, the first and second tabs 203 and 305 of the mounting panel 301 rest upon the first and second internal flanges 211 and 213 of the luminaire frame 51, thereby supporting the mounting panel within the luminaire frame. Once the mounting panel 301 has been secured to the luminaire frame 51, a ballast box 81 and an optical assembly 107 may be installed in the same manner as the first embodiment.

While an advantageous embodiment has been chosen to illustrate the invention, it will be understood by those skilled in the art that various changes and modifications may be made therein without departing from the scope of the invention as defined in the appended claims.

What is claimed is:

1. A light mounting panel for connecting to a luminaire frame, comprising:

a base having an upper surface and a lower surface and having first, second, third and fourth outer edges, said base having an opening and an inner edge defining said opening, said first outer edge being opposite said second outer edge and said third outer edge being opposite said fourth outer edge;

first, third and fourth walls extending upwardly from said upper surface of said base at said first, third and fourth outer edges, respectively, and contactable with internal flanges of the existing luminaire frame to align said mounting panel with the existing luminaire frame during installation;

a second wall extending upwardly and inwardly from said upper surface of said base at said second outer edge;

a first fixed tab extending laterally outwardly from said first wall to engage a first slot in the luminaire frame; and a second tab extending outwardly from said second wall and being movable between an insertion position within a periphery of said base and an installed position extending laterally outwardly from said periphery to engage a second slot in the luminaire frame.

2. A light mounting panel according to claim 1, wherein said opening in said base is quadrilateral having first, second, third and fourth inner edges, said first inner edge is opposite said second inner edge and said third inner edge is opposite said fourth inner edge.

3. A light mounting panel according to claim 2, further comprising a third tab extends substantially perpendicularly from each of said third and fourth inner edges for supporting a ballast box and positioning the ballast box between said third and fourth outer edges of said base.

4. A light mounting panel according to claim 3, further comprising a fourth tab extends substantially perpendicularly from said upper surface of said base for supporting the ballast box and positioning the ballast box between said first and second outer edges of said base.

5. A light mounting panel according to claim 4, wherein said fourth tab is oriented substantially perpendicularly to said third tab.

6. A light mounting panel according to claim 1, wherein said first, third and fourth walls extend substantially perpendicularly from said upper surface of said base at said first, third and fourth outer edges.

7. A light mounting panel according to claim 1, wherein said second wall extends at an acute angle from said upper surface of said base at said second outer edge.

8. A light mounting panel according to claim 1, wherein said first tab extends substantially perpendicularly from said first wall.

9. A light mounting panel according to claim 1, wherein a slot extends through said base adjacent to said second tab for receiving a tool to move said second tab from the insertion position to the installed position.

10. A light mounting panel according to claim 1, wherein notches extend in said second wall on both sides of said second tab.

11. A light mounting assembly according to claim 1, wherein said base, said first, second, third and fourth base walls, and said first and second tabs are unitarily formed.

12. A light mounting assembly, comprising:

a frame having a frame base, a frame inner edge defining a frame opening in said frame base, a frame inner wall extending upwardly from said frame inner edge, a first slot and second slot in said frame inner wall, and a frame flange extending inwardly from said frame inner wall;

a base having an upper and a lower surface and having first, second, third and fourth outer edges, said base having an opening and an inner edge defining said opening, said first outer edge being opposite said second outer edge, said third outer edge being opposite said fourth outer edge;

first, third and fourth base walls extending upwardly from said upper surface of said base at said first, third and fourth outer edges and being engagable with said frame flange to align said mounting panel with said frame during installation;

a second base wall extending upwardly and inwardly from said upper surface of said base at said second outer edge;

a first tab extending outwardly from said first base wall to engage a first slot in said frame; and a second tab extending outwardly from said second base wall and being movable between an insertion position within a periphery of said base and an installed position extending laterally from said periphery to engage said second frame slot.

13. A light mounting assembly according to claim 12, wherein said opening in said base is quadrilateral having first, second, third and fourth inner base edges, said first inner base edge being opposite said second inner base edge, said third inner base edge being opposite said fourth inner base edge.

14. A light mounting assembly according to claim 13, further comprising a third tab extends substantially perpendicularly from each of said third and fourth inner base edges supporting a ballast box and positioning said ballast box between said third and fourth outer edges of said base.

15. A light mounting assembly according to claim 14, wherein a fourth tab extends substantially perpendicularly from said upper surface of said base for supporting said ballast box, and positions said ballast box between said first and second outer edges of said base.

16. A light mounting assembly according to claim 12, wherein said frame opening is quadrilateral; and said first frame slot is opposite said second frame slot.

17. A light mounting assembly according to claim 12, wherein said first, third and fourth base walls extend substantially perpendicularly from said upper surface of said base at said first, third and fourth outer edges thereof.

18. A light mounting assembly according to claim 12, wherein said second base wall extends at an acute angle from said upper surface of said base at said second outer edge.

19. A light mounting assembly according to claim 12, wherein said first tab extends substantially perpendicularly from said first base wall.

20. A light mounting assembly according to claim 12, wherein a slot extends through said base adjacent to said second tab to receive a tool to move said second tab from said insertion position to said installed position.

21. A light mounting assembly according to claim 12, wherein notches extend in said second base wall on both sides of said second tab.

22. A light mounting assembly according to claim 15, wherein said fourth tab is oriented substantially perpendicularly to said third tab.

23. A light mounting assembly according to claim 1, wherein said base, said first, second, third and fourth base walls, and said first and second tabs are unitarily formed.

24. A luminaire assembly, comprising:

a base having an upper surface and a lower surface and having first, second, third and fourth outer edges, said first outer edge being opposite said second outer edge, said third outer edge being opposite said fourth outer edge, said base having a quadrilateral opening and first, second, third and fourth inner edges defining said opening, said first inner edge being opposite said second inner edge, said third inner edge being opposite said fourth inner edge;

first, third and fourth walls extending substantially perpendicularly from said upper surface of said first, third and fourth outer edges of said base;

a second wall extending inwardly from said upper surface of said second outer edge of said base;

at least one first tab extending outwardly substantially perpendicularly from said first wall for engaging a first slot in a luminaire frame;

at least one second tab extending outwardly from said second wall for engaging a second slot in the luminaire frame, said at least one second tab being deformable;

a ballast box positioned on said upper surface of said base above said opening in said base; and an optical assembly attached to said ballast box.

25. A luminaire assembly according to claim 24, wherein at least one third tab extends substantially perpendicularly from each of said third and fourth inner edges supporting and positioning said ballast box between said third and fourth outer edges of said base.

26. A luminaire assembly of claim 25, wherein at least one fourth tab extends substantially perpendicularly from said upper surface of said base supporting and positioning said ballast box between said first and second outer edges of said base.

27. A luminaire assembly according to claim 26, wherein said at least one fourth tab is oriented substantially perpendicularly to said at least one third tab.

28. A luminaire assembly according to claim 24, wherein a slot extends in said base adjacent to said at least one second tab to receive a tool for deforming said at least one second tab to engage said at least one second tab with the second slot in the luminaire frame.

29. A luminaire assembly of claim 24, wherein notches extend in said second wall on both sides of each said at least one second tab.

30. A light mounting panel for connecting to a luminaire frame, comprising:

a base having an upper surface and a lower surface and having first, second, third and fourth outer edges, said base having an opening and an inner edge defining said opening, said first outer edge being opposite said second outer edge and said third outer edge being opposite said fourth outer edge;

a first wall extending from said upper surface of said base at said first outer edge;

third and fourth walls extending upwardly from said upper surface of said base at said third and fourth outer edges, respectively, and contactable with internal flanges of the existing luminaire frame to align said mounting panel with the existing luminaire frame during installation;

a second wall extending upwardly and inwardly from said upper surface of said base at said second outer edge;

a first fixed tab for engaging the luminaire frame; and a second tab being movable between an insertion position and an installed position for engaging the luminaire frame.

31. The light mounting panel of claim 30, wherein said first fixed tab extends laterally outwardly from said second wall to engage a first slot in the luminarie frame.

32. A light mounting panel of claim 30, wherein said second movable tab extends outwardly from said first wall to engage a second slot in the luminaire frame.

33. A light mounting panel of claim 30, wherein said first fixed tab extends upwardly and outwardly from said second wall to engage a first internal flange of the luminaire frame.

34. A light mounting panel of claim 30, wherein said second movable tab is attached to said upper surface of said base proximal to said first wall to engage a second internal flange of the luminaire frame.

35. A light mounting panel according to claim 30, wherein said opening in said base is quadrilateral having first, second, third and fourth inner edges, said first inner edge is opposite said second inner edge and said third inner edge is opposite said fourth inner edge.

36. A light mounting panel according to claim 30, further comprising a third tab extending substantially perpendicularly from each of said third and fourth inner edges to support a ballast box and position the ballast box between said third and fourth outer edges of said base.

37. A light mounting panel according to claim 30, further comprising a fourth tab extending substantially perpendicularly from said upper surface of said base to support a ballast box and position the ballast box between said first and second outer edges of said base.

38. A light mounting panel according to claim 37, wherein said fourth tab is oriented substantially perpendicularly to said third tab.

39. A light mounting panel according to claim 30, wherein said first, third and fourth walls extend substantially perpendicularly from said upper surface of said base at said first, third and fourth outer edges.

40. A light mounting panel according to claim 30, wherein said second wall extends at an acute angle from said upper surface of said base at said second outer edge.

41. A light mounting panel according to claim 34, wherein a first slot extends through said base and a second slot extends through said second tab to receive a tool to move said second tab from the insertion position to the installed position.

42. A light mounting panel according to claim 32, wherein notches extend in said second wall on both sides of said second tab.

43. A light mounting assembly according to claim 30, wherein said base, said first, second, third and fourth base walls, and said first and second tabs are unitarily formed.

44. A light mounting assembly according to claim 30, wherein said base, said first, second, third and fourth base walls, and said first tab are unitarily formed.

45. A light mounting panel according to claim 44, wherein said second tab is attached to said upper surface of said base by a method selected from the group consisting of welding, spot welding, pot-riveting and fasteners.

46. A light mounting panel according to claim 30, wherein said first wall extends inwardly along said upper surface of said base, and said second tab extends upwardly from said first wall to engage a second internal flange.

47. A light mounting panel, a base having an upper surface and a lower surface and having first, second, third and fourth outer edges, said base having an opening and an inner edge defining said opening, said first outer edge being opposite said second outer edge and said third outer edge being opposite said fourth outer edge;

a first wall extending inwardly from said upper surface of said base at said first outer edge;

third and fourth walls extending upwardly from said upper surface of said base at said third and fourth outer edges, respectively, and contactable with internal flanges of the existing luminaire frame to align said mounting panel with the existing luminaire frame during installation;

a second wall extending upwardly and inwardly from said upper surface of said base at said first outer edge;

a first fixed tab extending outwardly from said second wall to engage the luminaire frame internal flanges; and a second tab extending upwardly from said first wall and being movable between an insertion position and an installed position to engage the luminaire frame internal flanges.

48. A light mounting panel according to claim 47, wherein said opening in said base is quadrilateral having first, second, third and fourth inner edges, said first inner edge is opposite said second inner edge and said third inner edge is opposite said fourth inner edge.

49. A light mounting panel according to claim 48, wherein a third tab extends substantially perpendicularly from each of said third and fourth inner edges for supporting a ballast box and positioning the ballast box between said third and fourth outer edges of said base.

50. A light mounting panel according to claim 49, further comprising a fourth tab extends substantially perpendicularly from said upper surface of said base for supporting the ballast box and positioning the ballast box between said first and second outer edges of said base.

51. A light mounting panel according to claim 50, wherein said fourth tab is oriented substantially perpendicularly to said third tab.

52. A light mounting panel according to claim 47, wherein said first, third and fourth walls extend substantially perpendicularly from said upper surface of said base at said first, third and fourth outer edges.

53. A light mounting panel according to claim 47, wherein said second wall extends at an acute angle from said upper surface of said base at said second outer edge.

54. A light mounting panel according to claim 47, wherein said first tab forms an acute angle with said second wall.

55. A light mounting panel according to claim 47, wherein a slot extends through said base for receiving a tool to move said second tab from the insertion position to the installed position.

56. A light mounting panel according to claim 47, wherein said second tab is substantially L-shaped.

57. A light mounting panel according to claim 47, wherein said base, said first, second, third and fourth base walls, and said first and second tabs are unitarily formed.

58. A light mounting panel according to claim 47, wherein a ballast box is positioned on said upper surface of said base above said opening in said base; and an optical assembly is attached to said ballast box.

59. A light mounting panel according to claim 47, wherein said first wall extends inwardly along said upper surface of said base.

* * * * *